United States Patent [19]

Boudreau

[11] Patent Number: 4,928,417

[45] Date of Patent: May 29, 1990

[54] GOLF CUP ADVERTISING DEVICE AND METHOD

[75] Inventor: Louis H. Boudreau, Phoenix, Ariz.

[73] Assignee: Boudreau/Darque, Inc., St. Louis, Mo.

[21] Appl. No.: 205,119

[22] Filed: Jun. 10, 1988

[51] Int. Cl.[5] ..... G09F 3/00

[52] U.S. Cl. ..... 40/642; 40/651; 273/34 R

[58] Field of Search ..... 273/32 R, 34 R, 34 A, 273/34 B, 177 R, 178 R, 181 R, 181 D; 446/46, 48; 116/173; 220/306, 307, 326, 86 R; 141/331-333; D21/86; 248/511, 519, 523; 40/642, 651

[56] References Cited

U.S. PATENT DOCUMENTS

| | | | |
|---|---|---|---|
| D253,004 | 9/1979 | Meckstroth | 446/48 |
| 2,107,944 | 2/1938 | Howard | 273/32 A |
| 3,580,580 | 5/1971 | Wark | 446/48 |
| 4,534,088 | 8/1985 | Ricke | 220/307 |

FOREIGN PATENT DOCUMENTS

| | | | |
|---|---|---|---|
| 491063 | 3/1953 | Canada | 273/34 R |

*Primary Examiner*—Richard J. Apley
*Assistant Examiner*—D. F. Crosby
*Attorney, Agent, or Firm*—Harry M. Weiss

[57] ABSTRACT

A substantially doughnut-shaped insert which will fit into any conventional golf cup to display an advertisement which is visible to a golfer when putting or when retrieving the golf ball from the hole.

13 Claims, 2 Drawing Sheets

GOLF CUP ADVERTISING DEVICE AND METHOD

BACKGROUND OF THE INVENTION

1. Field of the Invention

The present invention generally relates to an advertising device and method for golf and, more specifically, to an advertising device and method which uses a substantially doughnut-shaped device that is located within a standard golf cup, wherein the device contains an advertisement which is visible to a golfer when adjacent to the golf cup such as when putting or when retrieving a golf ball from the hole.

2. Description of the Prior Art

In the past, golf cups have been used solely for the purposes of containing golf balls and supporting golf flags. The conventional golf cup is of a standard diameter, with several holes located therein for drainage, and a center tube, cavity or recess to support the golf flag stick. Various prior art patents disclose different things that have been done involving golf cups. Jacoby, (U.S. Pat. No. 2,684,245) discloses a golf hole protector which is designed to protect the wall of the hole above the putting cup. English (U.S. Pat. No. 4,360,200) teaches an improved golf stick holder which prevents tilting of the flag.

However, despite these prior art references, the golf cup still remained with only two basic functions; to contain the golf ball and support the golf flag stick. In view of the significant amount of interest in golf and the large amount of golf players, there was a need to use a golf cup as an advertising medium.

SUMMARY OF THE INVENTION

It is an object of this invention to provide an advertising device and method for golf cups.

It is a further object of this invention to provide an advertising device and method for displaying an advertisement in a golf cup that is visible to a golfer when adjacent to the cup such as when putting or when retrieving the golf ball from the hole.

It is a still further object of this invention to provide an advertising device and method for use in a golf cup which will detachably latch into any conventional golf cup.

The aforementioned and other objects are accomplished, according to the present invention, by using a substantially doughnut-shaped insert that contains an advertisement which will fit or snap into any conventional golf cup.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENTS

Figure 1:
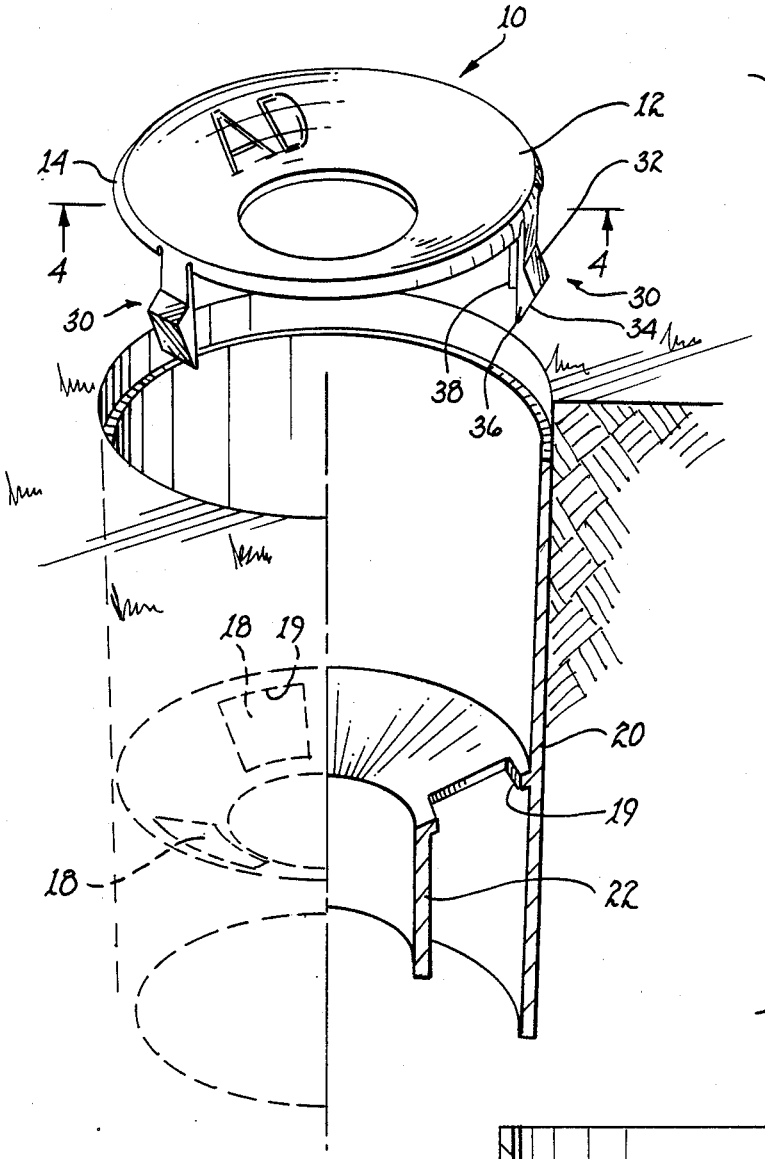
FIG. 1 is an isometric view of one embodiment of the golf cup advertising device as it fits into and is attached within a golf cup.

Referring now to the FIGS. of the accompanying drawings which set forth the present invention in greater detail and in which like numerals designate like features, a golf cup advertising device 10 is generally comprised of an annular substantially doughnut-shaped ring member 12, an outer peripheral flange 14, and a plurality of prong type attachment members 30. The annular ring member 12 is preferably slanted downwardly from outside to inside, and closely fits within the bottom portion of a golf cup 20. The outside diameter of the annular ring member 12 is preferably slightly smaller than the inside diameter of a conventional golf cup 20. The diameter of the central opening of the annular substantially doughnut-shaped ring member 12 measures approximately 1½ inches thereby allowing a golf flag stick to pass through the center of the ring member 12 and thereby enter into a flag stick holder portion 22 of the golf cup 20. However, a golf ball falling into the golf cup 20 will not fall through or become wedged in the center opening of the ring member 12. The outer peripheral flange 14 extends downward, and runs along forming the periphery of the annular ring member 12. The outer peripheral flange 14 preferably extends downward at least approximately ⅛th of an inch. The outer peripheral flange 14 also may extend downwardly at an outward angle rather than vertically, if desired.

Figure 3:
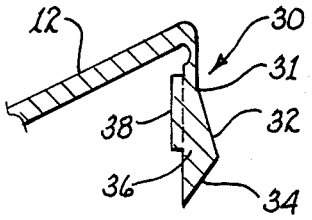
FIG. 3 is an enlarged view of one of the prong type attachment members of the advertising device of FIG. 1.
Figure 4:
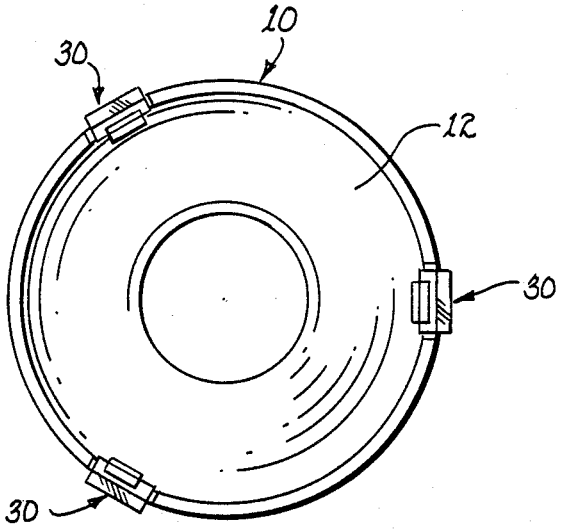
FIG. 4 is a bottom view of the advertising device of FIG. 1 taken along line 4—4 of FIG. 1.
Figure 5:
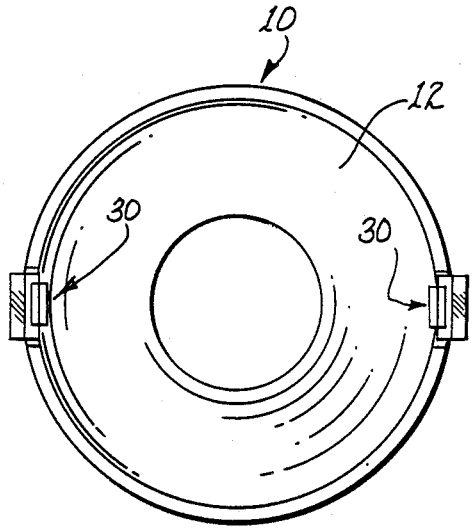
FIG. 5 is a bottom view of a second embodiment of an advertising device in accordance with this invention.

As best shown in FIG. 3, the prong type attachment members 30 extend downward and are preferably attached to the outer peripheral flange 14 of the ring member 12 which is preferably made of plastic or a material such as aluminum that can resist water damage. Each one of the prong members 30 are inserted into a drainage hole 18 in the conventional golf cup 20. In the first embodiment of FIG. 1, the golf cup advertising device 10 is provided with an odd number preferably three prong members 30, as shown in FIG. 4. Referring to FIG. 4, the first embodiment preferably comprises three prong members 30, spaced evenly (120 apart) around the periphery of the annular ring member 12. The first embodiment advertising device 10 is therefore adapted to be inserted within a golf cup 20 with an odd number (three, five etc.) of drainage holes 18 starting with a minimum of three holes 18. The second embodiment advertising device 10 (see FIG. 5) has an even number of prong members 30, preferably two or four prong members 30 in order to be used in a golf cup 20 having an even number of drainage holes 18. For example, using the advertising device 10 of FIG. 5, the two prongs 30 are equally spaced from each other and located 180 apart.

Figure 2:
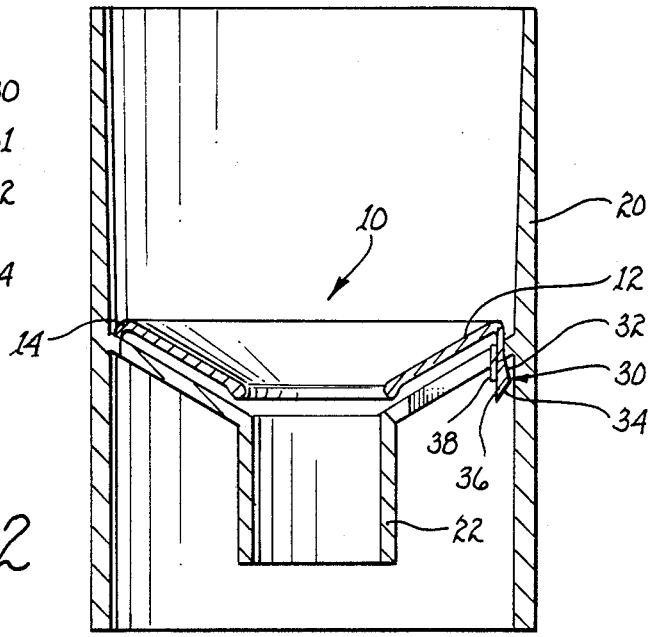
FIG. 2 is a front cross sectional view of the embodiment of FIG. 1.

With reference to FIGS. 1, 2 and 3, the prong members 30 are designed to have a triangular shaped lip 36 on the outside end portion of the prong members 30. The upper side of the triangular lip 36 has a downward outwardly extending slope portion 32 to permit rapid removal of the device 10 from the holes 18 in the golf cup 20. The lower side of the triangular lip 36 is comprised of an upward outwardly sloped angle portion 34 to provide ease in installing the device 10 into the holes 18 of the golf cup 20. The prong members 30 preferably further comprise a widened reinforcement section 38 to provide greater structural strength in order to prevent prong breakage. As shown in FIG. 2, each prong member 30 passes through the opening 18 (see FIG. 1) and attaches to the inside rim portion 19 (see FIG. 1) of the opening 18 by having recess portion 31 butt up against the flat exterior vertical portion of the inside rim portion 19. Thus, a snap attachment fit is provided by means of slope portion 34 which first makes contact with the rim portion 19 and then the rim portion 19 snaps into position on recess portion 31. In removing the device 10, the slope portion 32 facilitates rapid and easy sliding of the device 10 out of the cup 20 since the rim portion 19 forces each prong 30 inwardly while riding down the slope portion 32.

Figure 6:
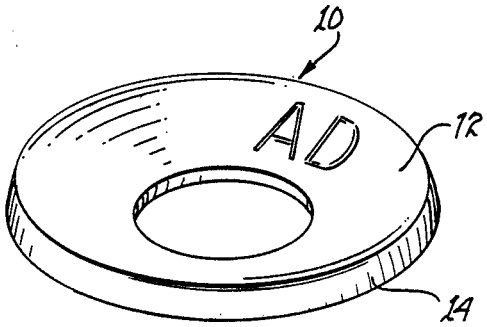
FIG. 6 is a perspective view of a third embodiment of an advertising device in accordance with this invention.

The third embodiment of the device 10 does not comprise any prong members 30, as shown in FIG. 6. In this embodiment, the device 10 is rapidly inserted into the cup 20 and sits at the bottom portion thereof leaving a small space around the perimeter to permit water to pass therethrough.

Figure 7:
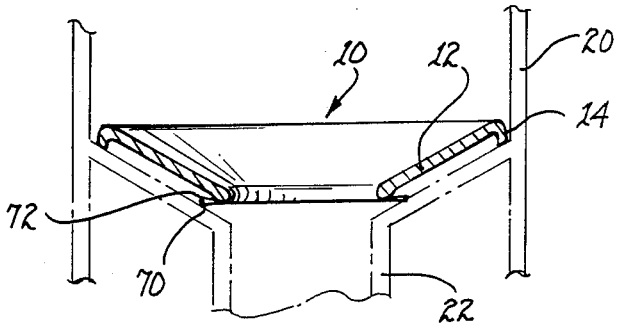
FIG. 7 is a front cross-sectional view of the third embodiment of the golf cup advertising device of FIG. 6 shown located in a golf cup.

As best shown in FIG. 7, the device 10 of FIG. 6 may further comprise an inner periphery flange 70. The inner periphery flange 70 has an upper surface 72 that is parallel to the annular ring member 12.

The device 10 may be constructed of a molded plastic with the advertisement printed directly into the annular ring 12.

The device 10 can also be constructed of a transparent molded plastic. An advertisement can then be affixed to the lower surface of the annular ring member 12 and held in place by the inwardly extending peripheral flange 70 in contact with the top surface 72 thereof. The advertisement can be easily changed by substituting advertisements, as desired. A key feature is the downward inwardly extending slope of the ring member 12 which permits easy viewing of the advertisement from even a distance at an angle away from the golf hole.

The device 10 is simply installed by lining up the prong members 30 with the golf cup drainage holes 18, and pushing downward until the device 10 snaps into place. The device 10 is easily removed by pulling upward on the device 10 until it snaps out of the golf cup 20. The device 10 embodiment of FIGS. 6 and 7 without prong members 30 is simply pushed or dropped downward until into the golf cup 20 for installation and lifted upwards for easy removal from the golf cup 20.

While the invention has been particularly shown and described in reference to the preferred embodiments thereof, it will be understood by those skilled in the art that changes in form and details may be made without departing from the spirit and scope of the invention.

I claim:

1. An advertising device for a golf cup comprising:
a golf cup;
a substantially doughnut-shaped annular ring member having a center opening and having an external peripheral portion dimensioned to co-axially fit into said golf cup; and
advertising display means coupled to said ring member for displaying an advertisement visible to a golfer when adjacent to said golf cup.

2. An advertising device in accordance with claim 1 further comprising an outer peripheral flange member extending downward from said annular ring member.

3. An advertising device in accordance with claim 2 wherein said outer peripheral flange member extends downward at an outward angle.

4. An advertising device in accordance with claim 1 further comprising a plurality of prong members; said prong members being attached to a peripheral edge portion of said annular ring member and extending downward to detachably couple with the rim portions of a plurality of drainage holes in said golf cup.

5. An advertising device in accordance with claim 4 wherein said prong members further comprise triangular-shaped lip means for providing easy installation and removal, said triangular-shaped lip is located on an outer lower edge of said prong members.

6. An advertising device display insert in accordance with claim 1 further comprising an inner peripheral flange member located beneath said opening and towards the outer peripheral portion of said annular ring.

7. An advertising device in accordance with claim 6 further comprising an upper surface portion attached to said inner peripheral flange member parallel to the perimeter portion of said annular ring.

8. An advertising device in accordance with claim 1 wherein said display means upper surface is constructed out of a transparent material.

9. A method for displaying an advertisement in a golf cup comprising the steps of:
providing a substantially doughnut-shaped ring member which coaxially fits into a conventional golf cup;
providing an advertisement on said ring member; and inserting said ring member into a golf cup.

10. A method for displaying an image in a golf cup in accordance with claim 9 wherein the upper surface of said ring member is constructed from a transparent material.

11. A method for displaying an image in a golf cup in accordance with claim 9 wherein said advertisement is printed directly on the upper surface of the ring member.

12. A method for displaying an image in a golf cup in accordance with claim 9 wherein said advertisement is an advertisement for a product or service.

13. An advertising device for a golf cup, comprising:
a substantially doughnut-shaped annular ring member having a center opening and having an external peripheral portion dimensioned to co-axially fit into a conventional golf cup;
advertising display means coupled to said ring member for displaying an advertising visible to a golfer when adjacent to the golf cup;
an inner peripheral flange member located beneath said opening and extending towards the external peripheral portion of said annular ring; and
an upper surface portion of said inner peripheral flange member parallel to the peripheral portion of said annular ring.

* * * * *